US007878345B2

(12) United States Patent
Tourlamain

(10) Patent No.: US 7,878,345 B2
(45) Date of Patent: Feb. 1, 2011

(54) FOLDABLE FRAME

(75) Inventor: Ronny Tourlamain, Merelbeke (BE)

(73) Assignee: Conteyor Multibag Systems, N.V., Merelbeke (BE)

( * ) Notice: Subject to any disclaimer, the term of this patent is extended or adjusted under 35 U.S.C. 154(b) by 533 days.

(21) Appl. No.: 10/528,884

(22) PCT Filed: Oct. 7, 2003

(86) PCT No.: PCT/EP03/50698

§ 371 (c)(1),
(2), (4) Date: Jan. 17, 2006

(87) PCT Pub. No.: WO2004/035402

PCT Pub. Date: Apr. 29, 2004

(65) Prior Publication Data

US 2006/0138067 A1 Jun. 29, 2006

(30) Foreign Application Priority Data

Oct. 10, 2002 (DE) ..... 202 15 597 U

(51) Int. Cl.
*A47B 43/00* (2006.01)

(52) U.S. Cl. ..... 211/195

(58) Field of Classification Search ..... 211/195, 211/38, 85, 118; 52/646, 645, 79.5, 66, 69, 52/71, 68, 36.1, 36.4; 135/126, 128, 143, 135/146, 148, 151

See application file for complete search history.

(56) References Cited

U.S. PATENT DOCUMENTS 1,216,250 A * 2/1917 Bittle ..... 312/6

(Continued)

FOREIGN PATENT DOCUMENTS

DE 2250812 10/1972

(Continued)

*Primary Examiner*—Sarah Purol
(74) *Attorney, Agent, or Firm*—Michael L. Dunn

(57) ABSTRACT

A folding rack for receiving and transporting bags, for receiving objects, to be suspended in the rack. The rack has a base part and side frame parts which are connected articulatedly to the base part at their lower end and are pivotal at least about 90° or more in relation to the base part, from a position perpendicular to the base part into a position substantially parallel to the base part. A cross strut is articulated to an upper end region of each of the side frame parts. The struts are pivotal toward one another parallel to the base part, and free ends thereof are connectable to one another in a substantially rigid manner so that the upper end regions of the side frame parts are held by the cross struts, which are articulated to the upper regions of the side frame parts and are rigidly connected to one another, at a minimum spacing defined by the cross struts. In a mutually connected condition, as above described, the free ends of the cross struts engage in one another in a connection region and are held together in substantially rigid manner by a pipe clamp reaching over the connection region, and in an unfolded condition the side side parts extend parallel to one another and are substantially perpendicular to the base part, so that similar racks can be stacked on top of one another with side frame parts aligned with one another.

14 Claims, 25 Drawing Sheets

U.S. PATENT DOCUMENTS

| | | | | | |
|---|---|---|---|---|---|
| 1,394,007 | A | * | 10/1921 | Hall | 312/6 |
| 2,517,757 | A | * | 8/1950 | Adlerstein | 312/3 |
| 3,519,318 | A | * | 7/1970 | Hagen | 312/245 |
| 3,810,482 | A | * | 5/1974 | Beavers | 135/147 |
| 3,967,327 | A | * | 7/1976 | Severson | 5/9.1 |
| 4,066,089 | A | * | 1/1978 | Rainwater | 135/151 |
| 4,270,816 | A | * | 6/1981 | Erickson et al. | 312/3 |
| 4,382,640 | A | * | 5/1983 | Kashden | 312/5 |
| 4,735,320 | A | * | 4/1988 | Hoss | 206/583 |
| 5,013,100 | A | * | 5/1991 | Zich | 312/200 |
| 5,274,980 | A | * | 1/1994 | Zeigler | 52/646 |
| 5,560,502 | A | * | 10/1996 | Hsiung | 211/195 |
| 5,833,329 | A | * | 11/1998 | Smith et al. | 312/3 |
| 5,957,310 | A | * | 9/1999 | Mitchell | 211/186 |
| 6,089,247 | A | * | 7/2000 | Price | 135/145 |
| 6,089,394 | A | * | 7/2000 | Ziglar | 220/6 |
| 6,305,764 | B1 | * | 10/2001 | Kortman et al. | 312/3 |
| D461,638 | S | * | 8/2002 | Kellogg et al. | D3/304 |
| 6,497,542 | B1 | | 12/2002 | Vermeulen | 410/43 |
| 6,516,823 | B1 | * | 2/2003 | Glover et al. | 135/94 |
| 6,648,142 | B1 | | 11/2003 | Hugenholtz et al. | 206/425 |
| 6,666,223 | B2 | * | 12/2003 | Price et al. | 135/131 |
| 6,719,157 | B2 | * | 4/2004 | Stoddart et al. | 211/118 |
| 6,752,258 | B2 | | 6/2004 | Ludwig et al. | 198/465.3 |
| 6,766,623 | B1 | * | 7/2004 | Kalnay | 52/641 |
| 6,926,020 | B2 | * | 8/2005 | Zheng | 135/126 |
| D551,452 | S | * | 9/2007 | Kellogg et al. | D3/304 |
| 2003/0029490 | A1 | * | 2/2003 | Price et al. | 135/131 |
| 2006/0138067 | A1 | * | 6/2006 | Tourlamain | 211/195 |

FOREIGN PATENT DOCUMENTS

| | | | |
|---|---|---|---|
| DE | 4138507 | A1 | 5/1993 |
| DE | 20012639 | U1 | 10/2000 |
| DE | 20204917 | U1 | 6/2002 |
| EP | 0612301 | B1 | 8/1994 |
| WO | WO9310024 | | 5/1993 |

* cited by examiner

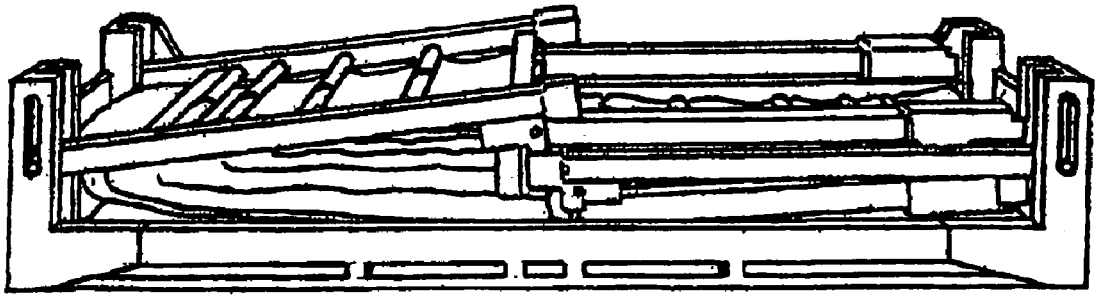
*Fig. 6.1*

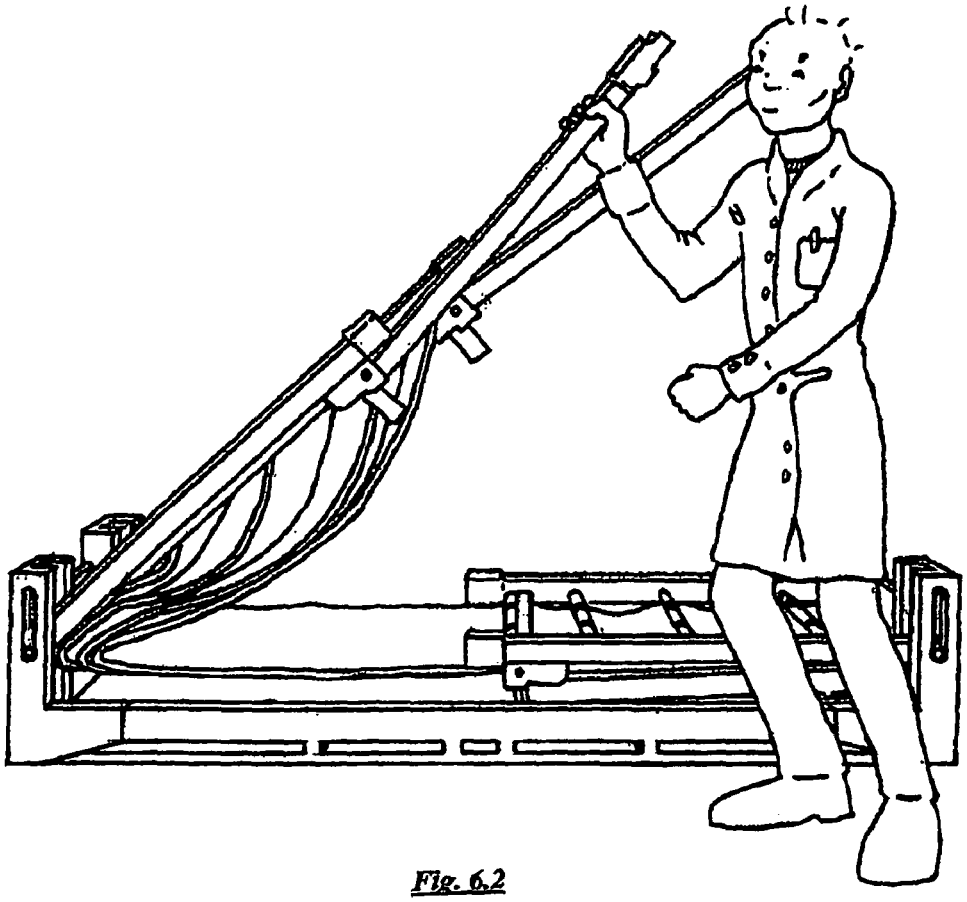
*Fig. 6.2*

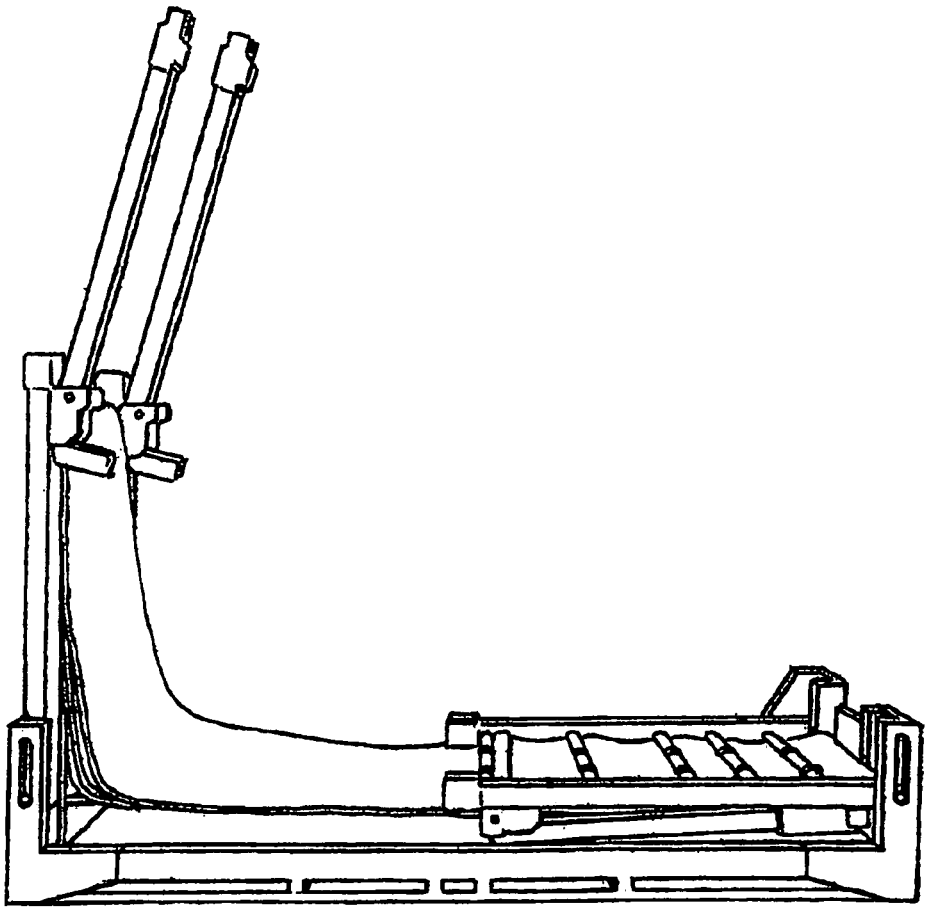
*Fig. 6.3*

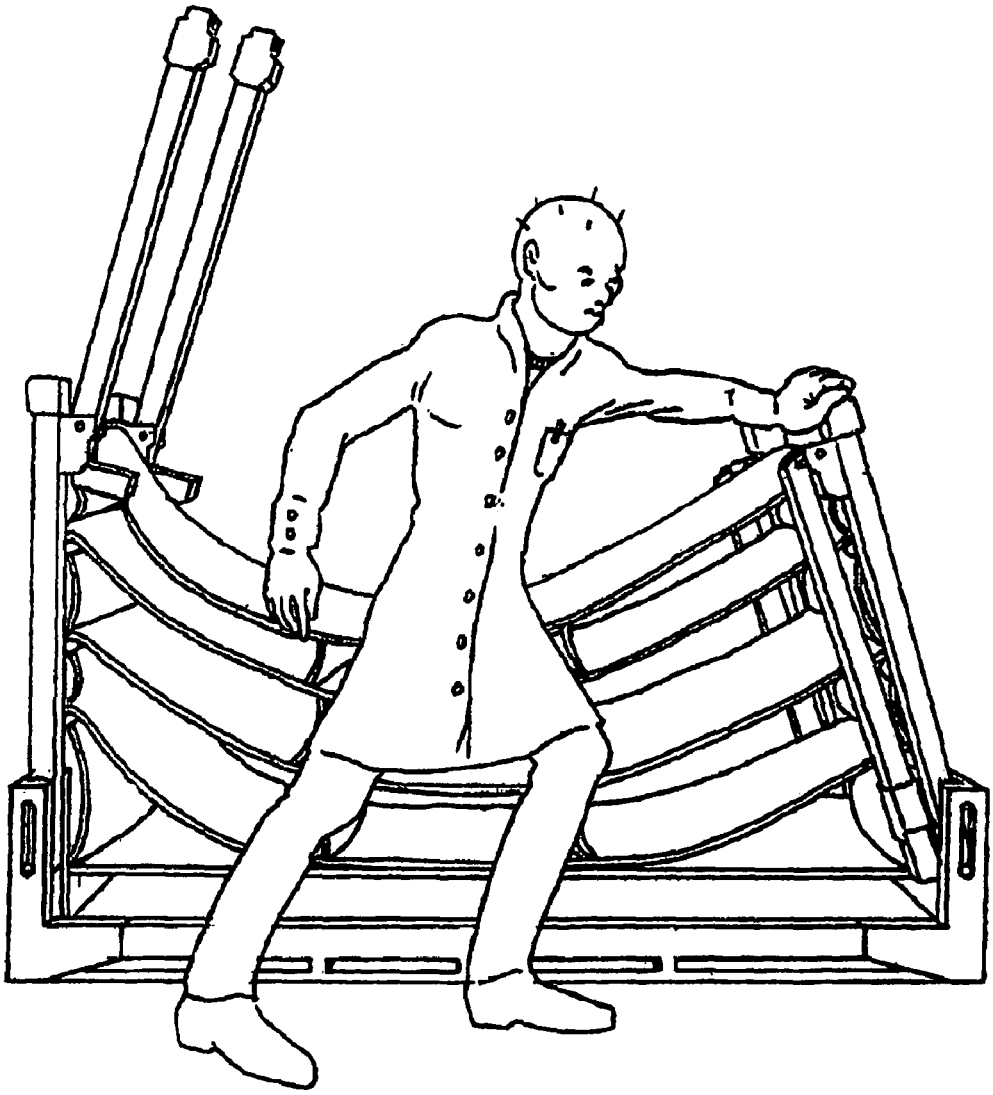
*Fig. 6.4*

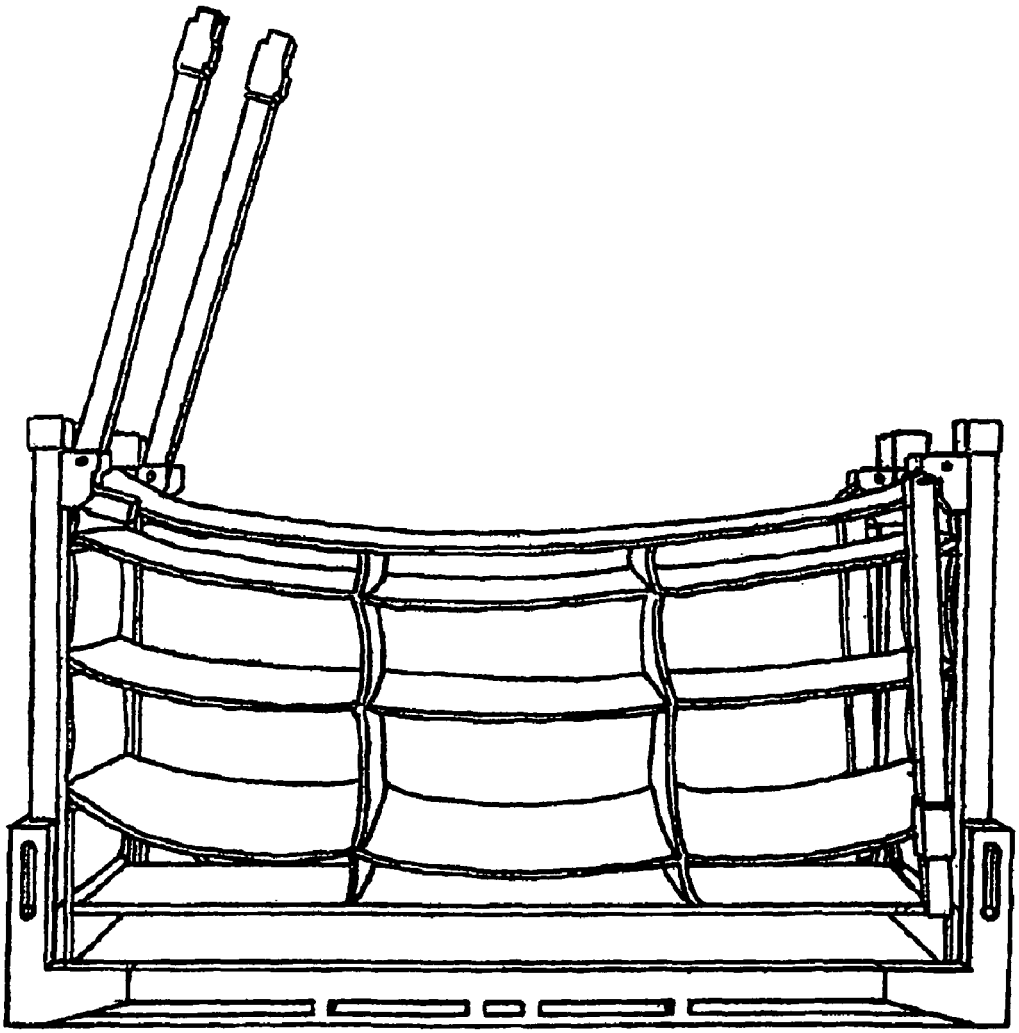
Fig. 6.5

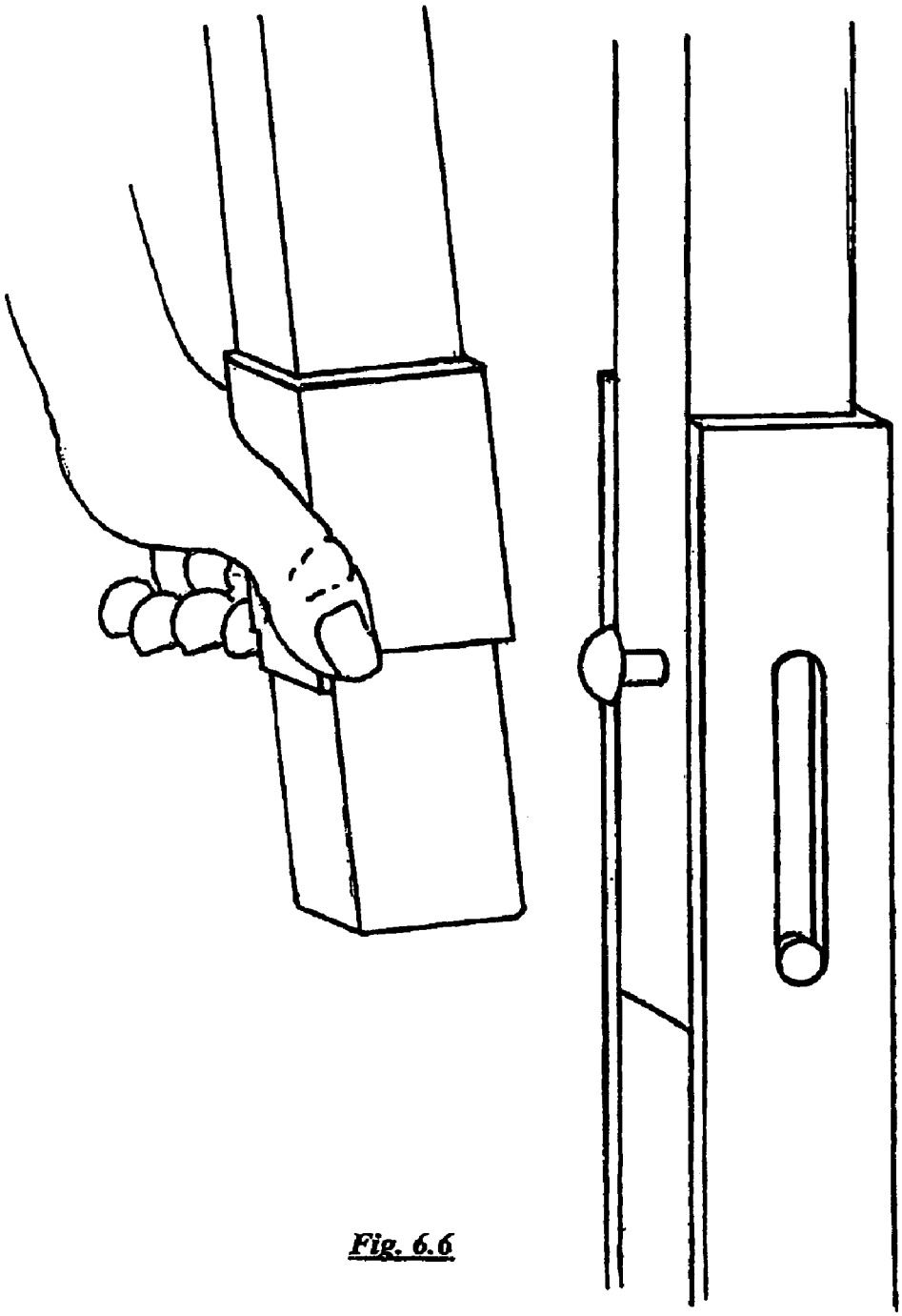
*Fig. 6.6*

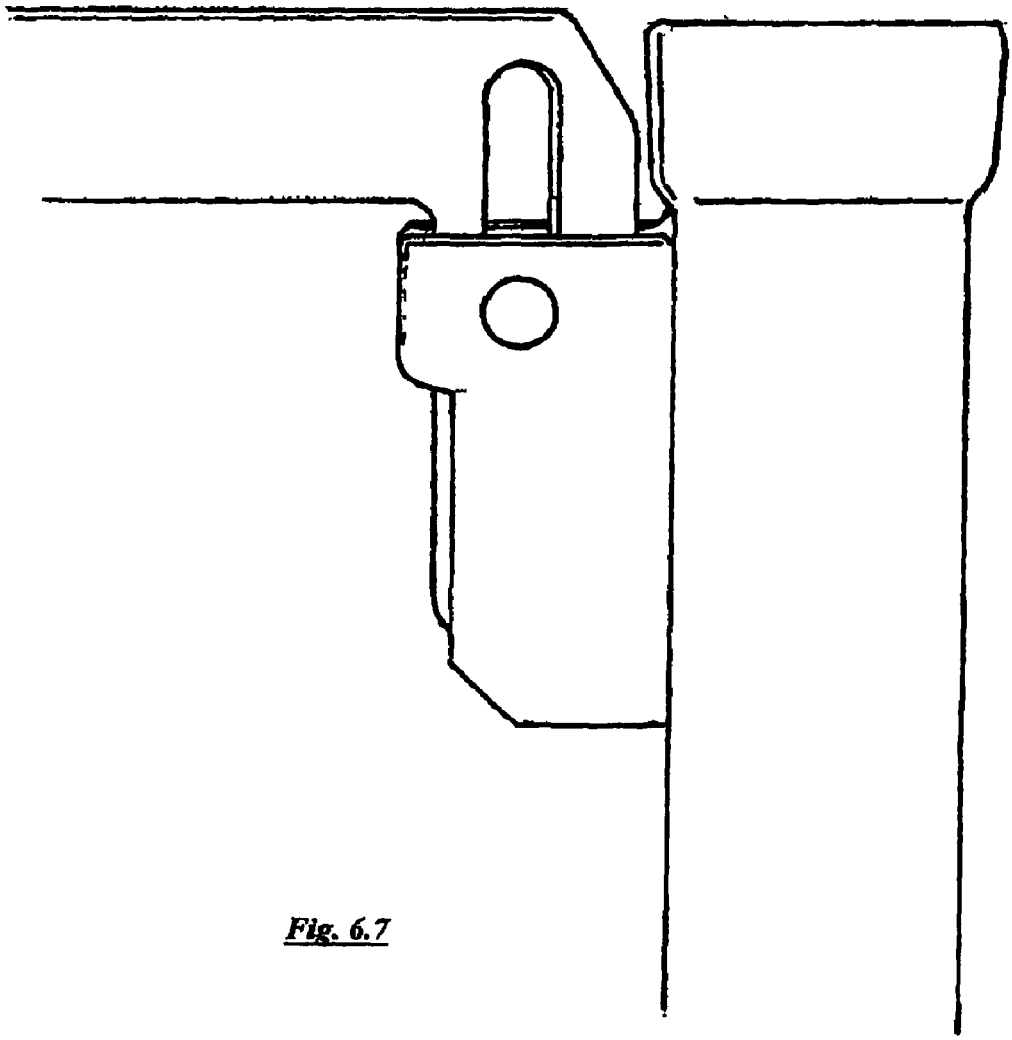
*Fig. 6.7*

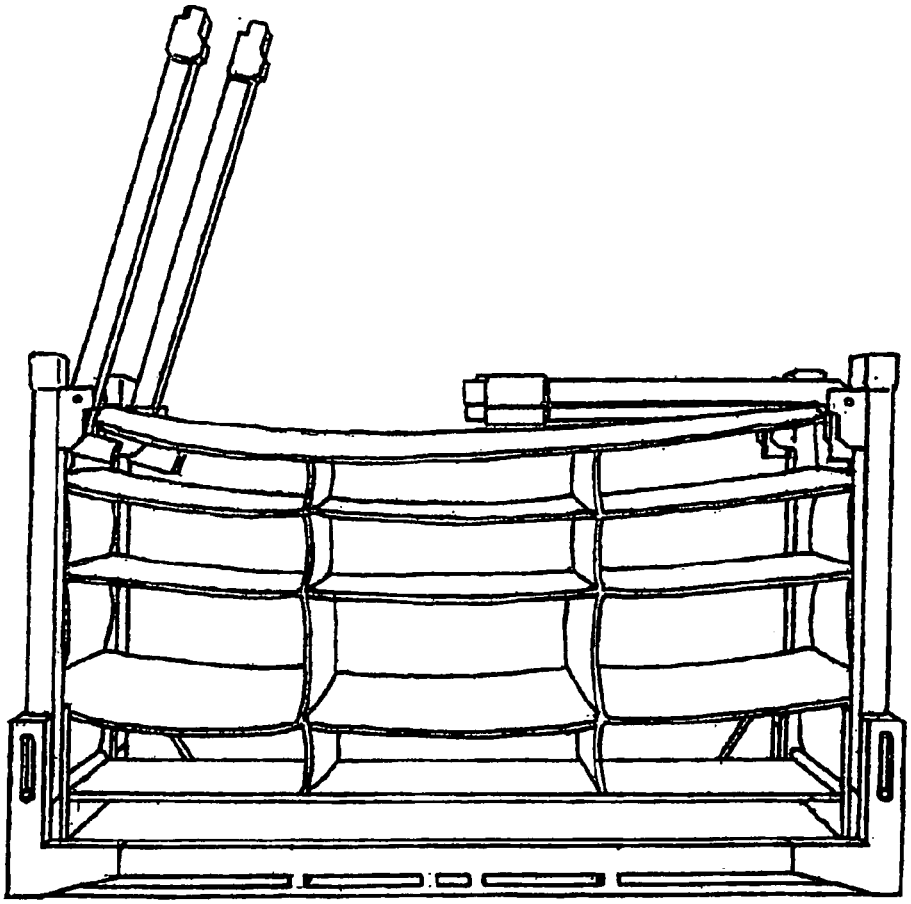
*Fig. 6.8*

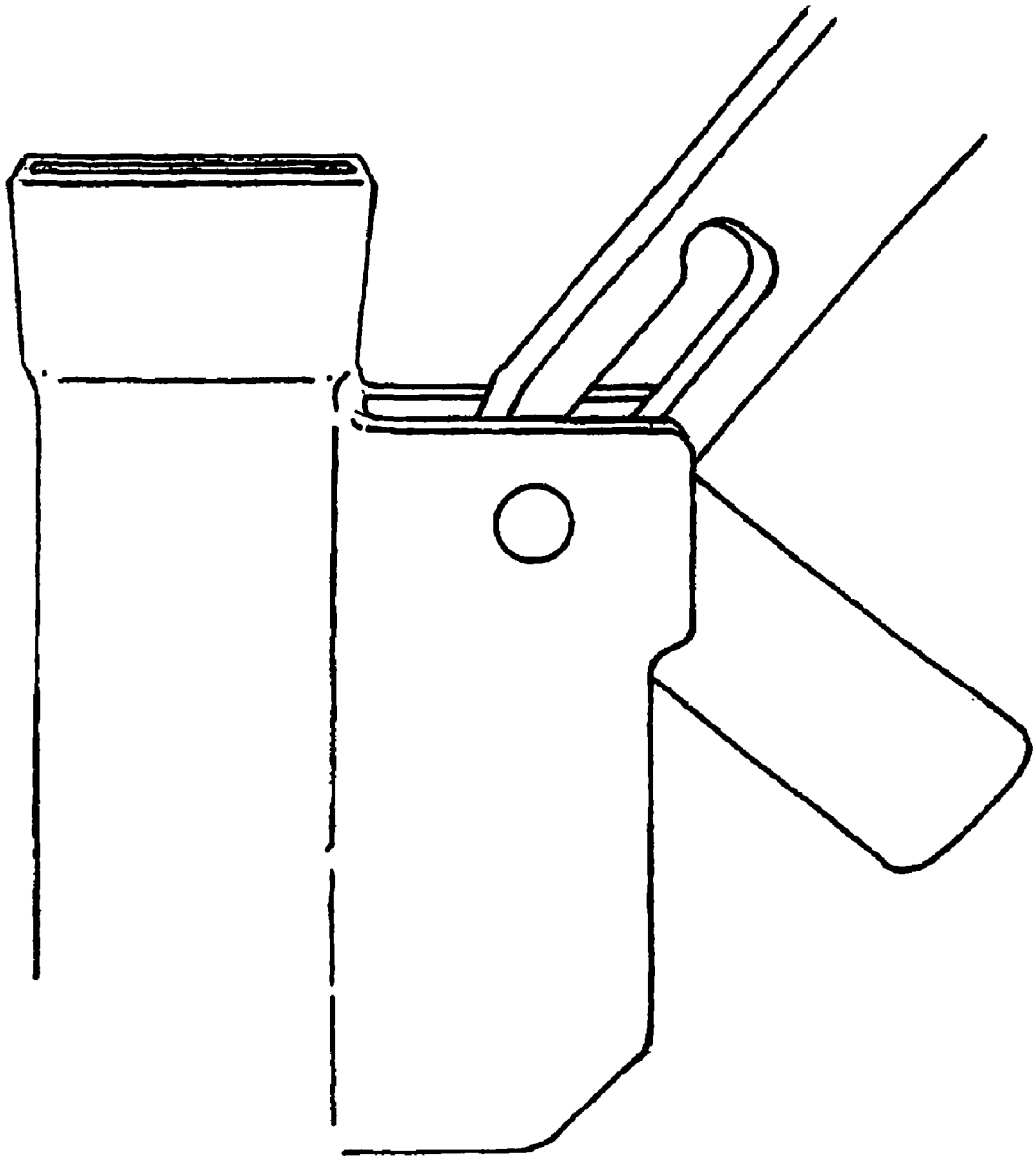
*Fig. 6.9*

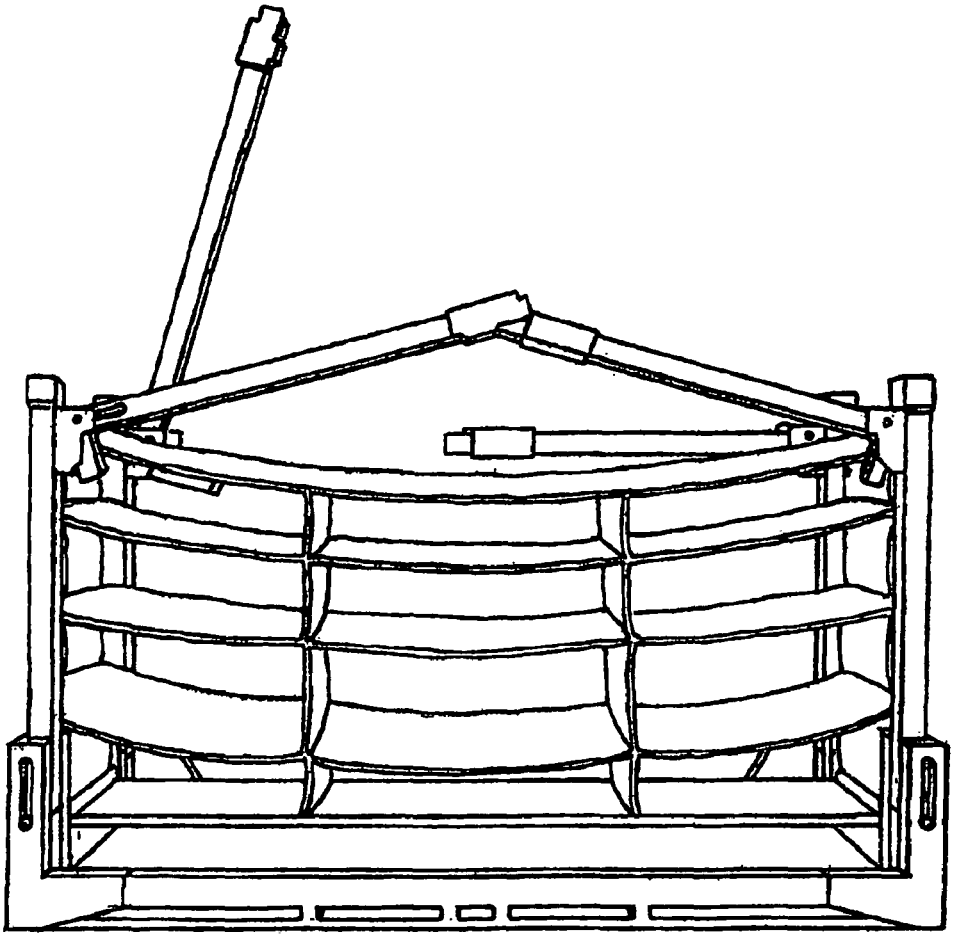
*Fig. 6.10*

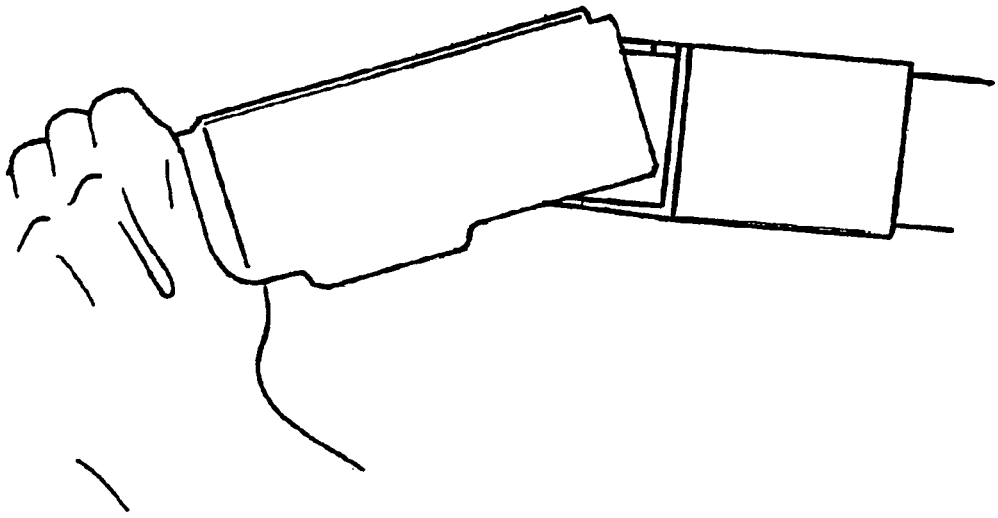
*Fig. 6.11*

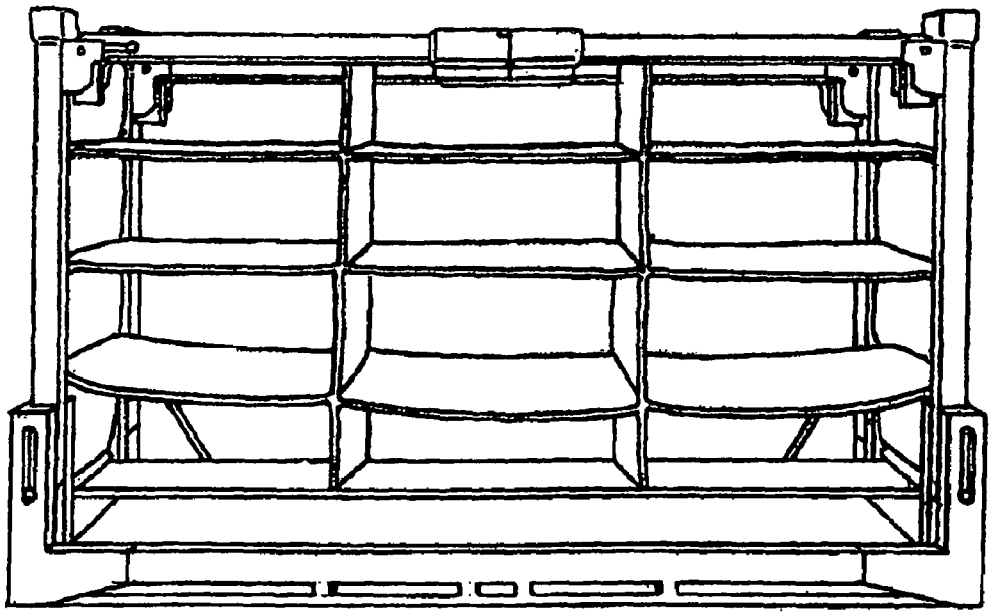
*Fig. 6.12*

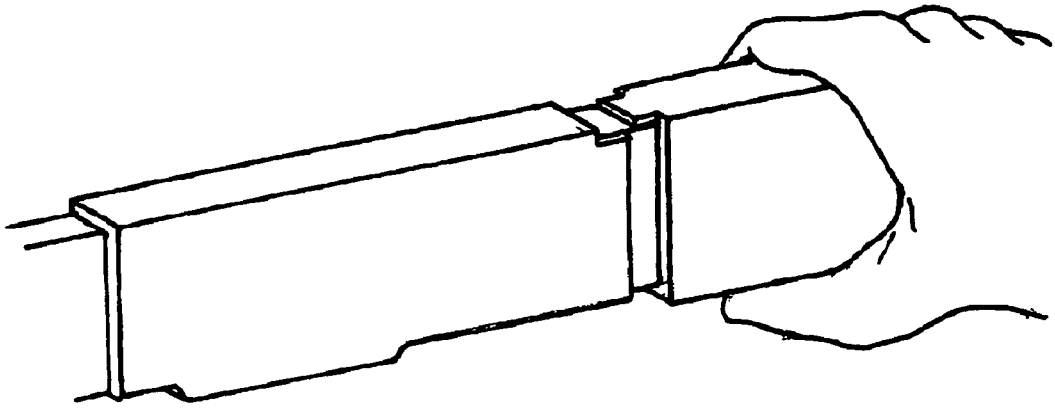
*Fig. 7.1*

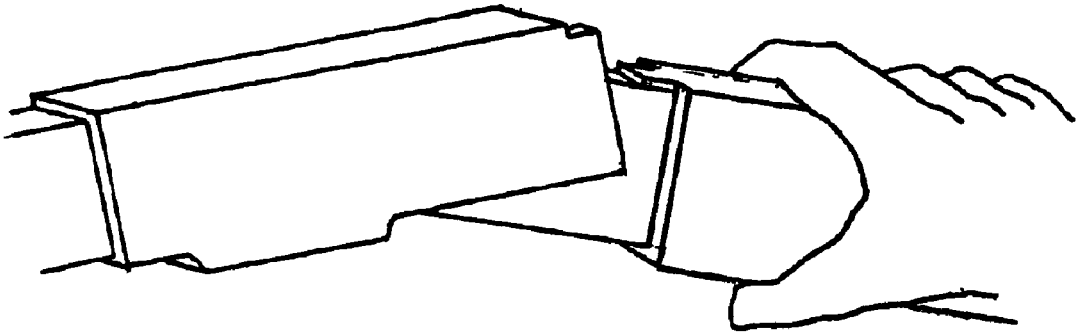
Fig. 7.2

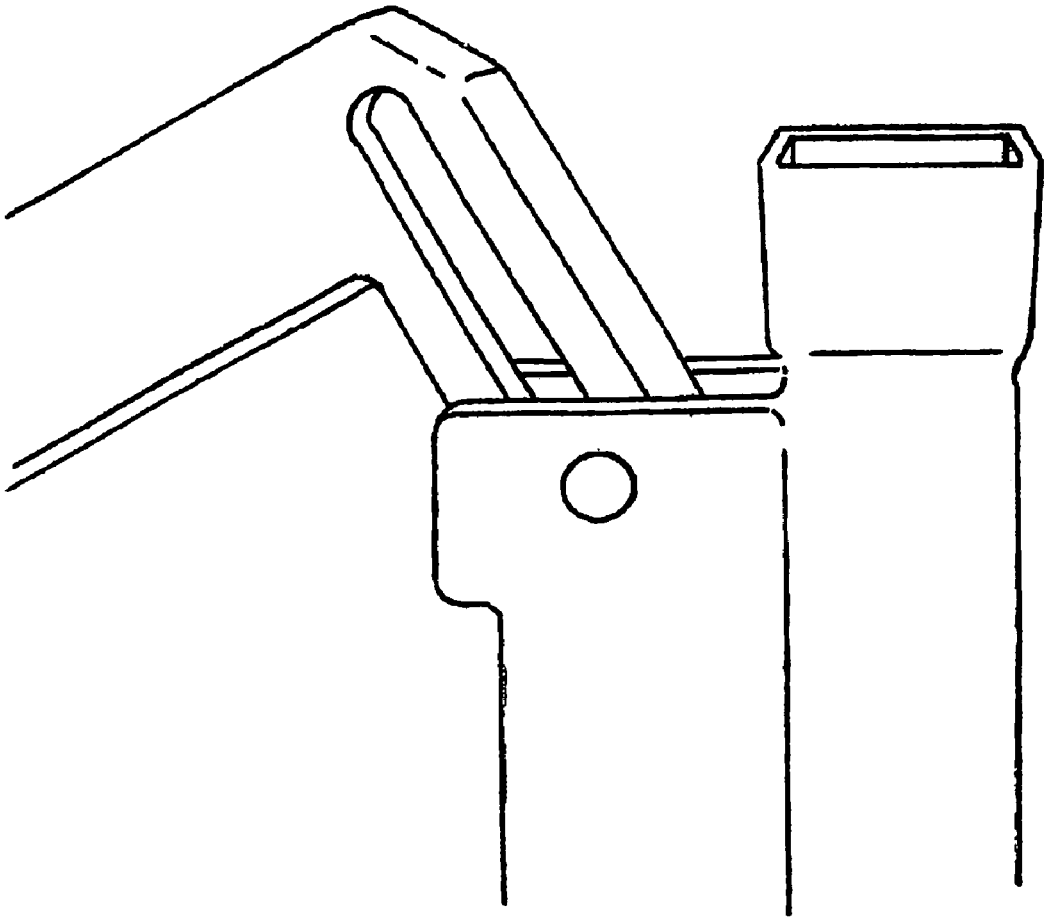
*Fig. 7.3*

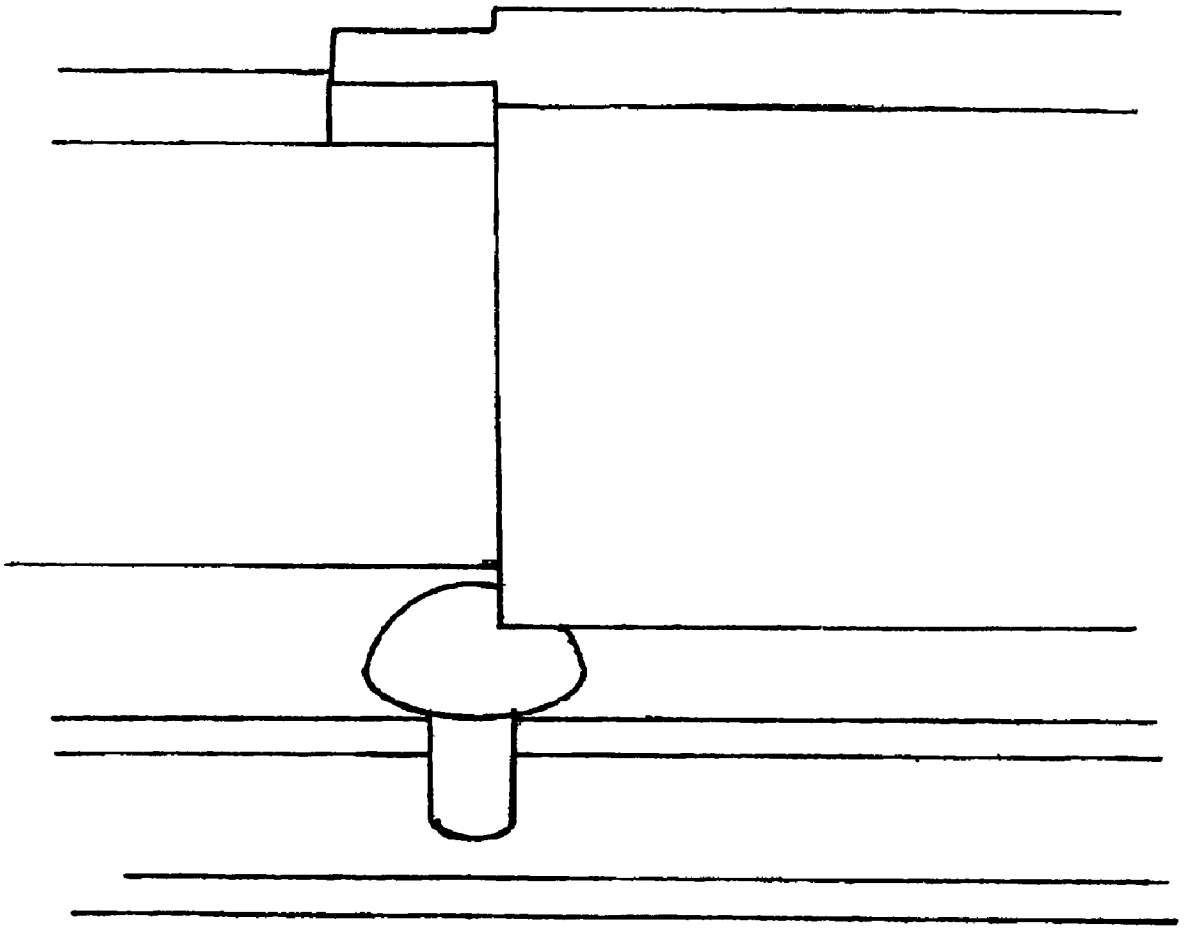
*Fig. 7.4*

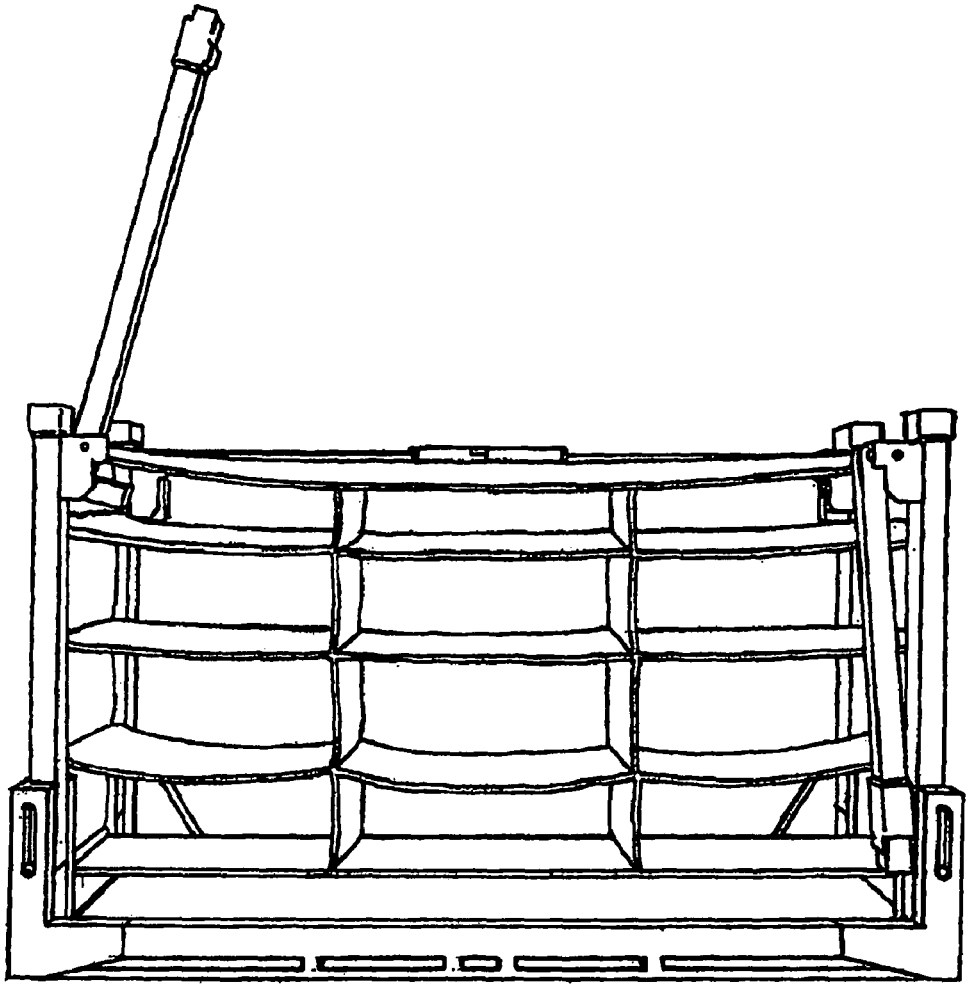
*Fig. 7.5*

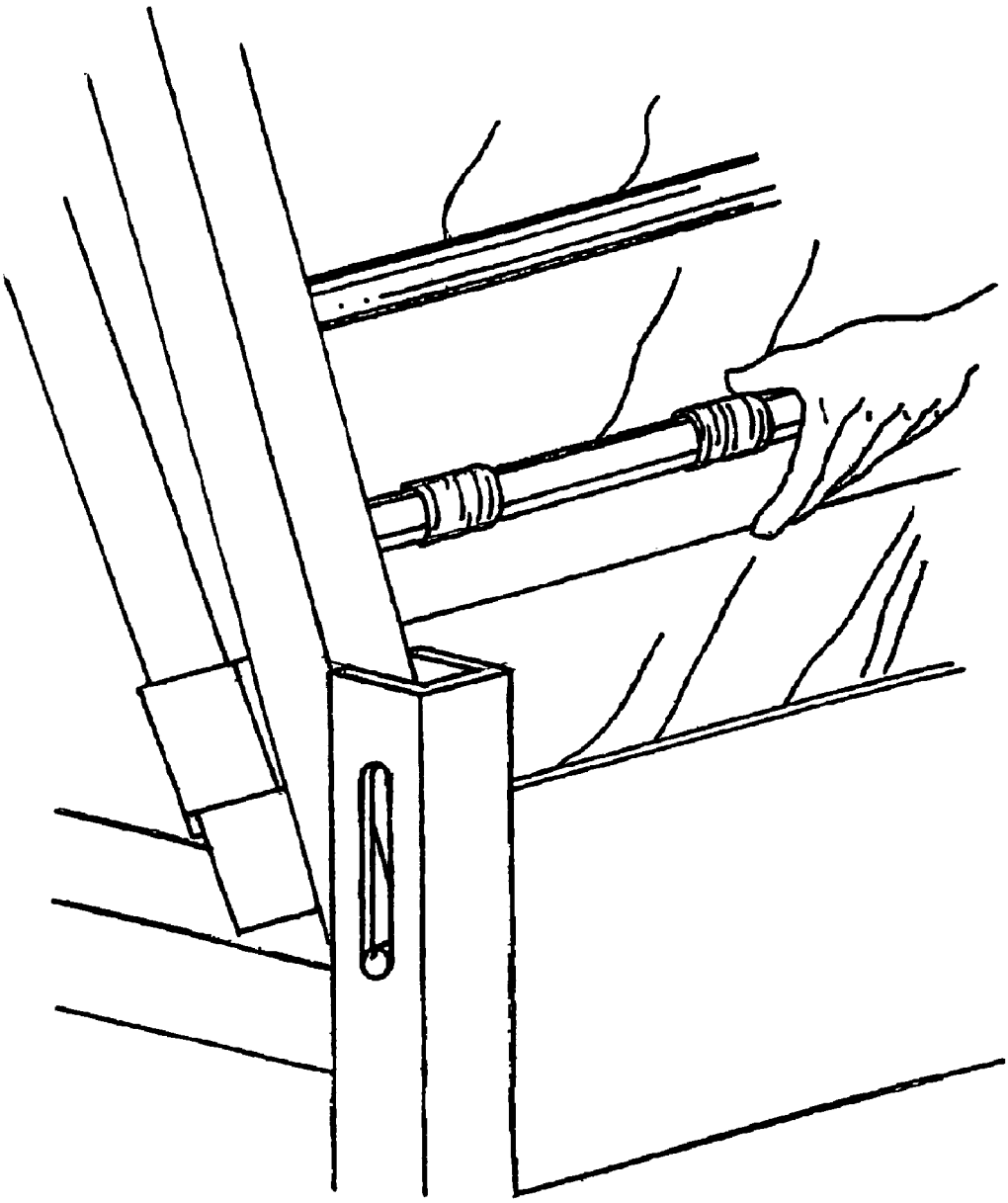
*Fig. 7.6*

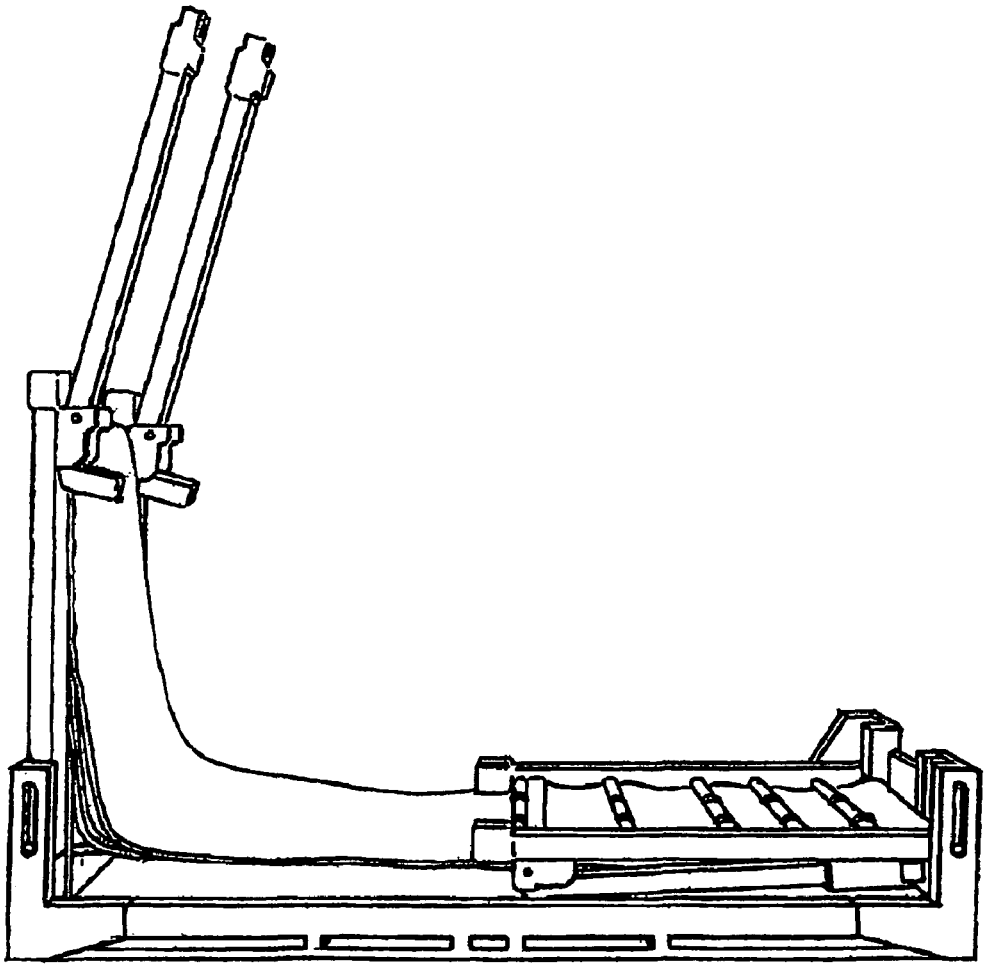
*Fig. 7.7*

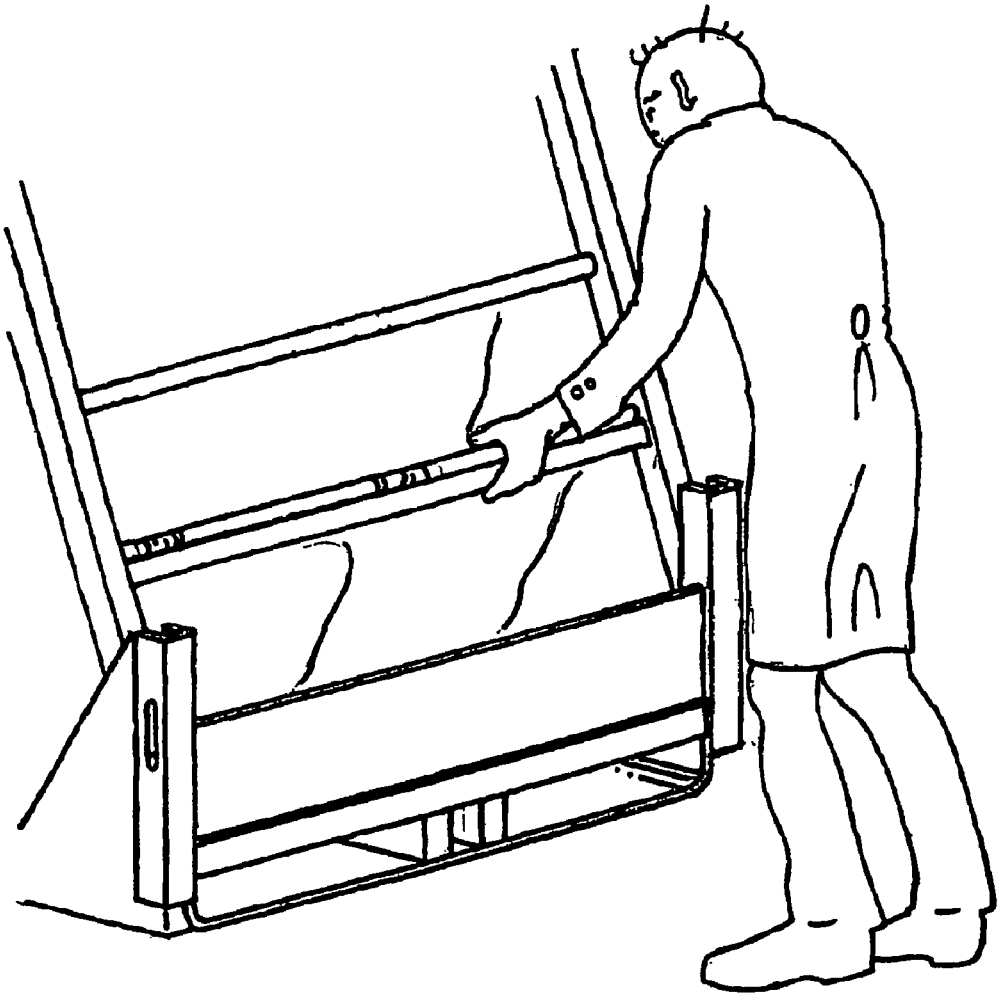
*Fig. 7.8*

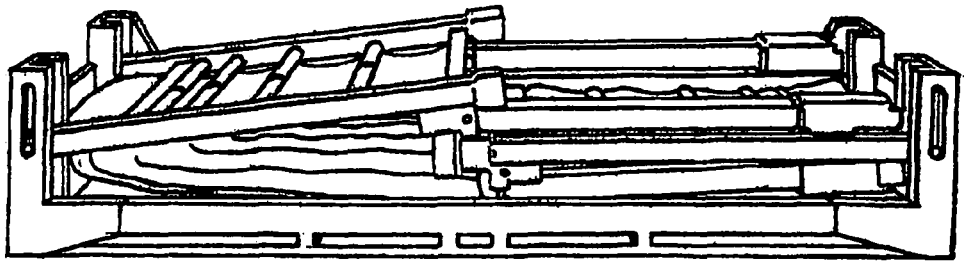
*Fig. 7.9*

FOLDABLE FRAME

CROSS REFERENCE TO RELATED APPPLICATIONS

This claims priority from German Patent Application 20215597.8, filed Oct. 10, 2002 and is a U.S. Nationalization of International Application No. PCT/EP2003/050698.

BACKGROUND OF THE INVENTION

The present invention relates to a folding rack for receiving and transporting bags to be received in the rack, which for their part are provided for receiving objects to be transported and/or stored, having a base part and lateral frame parts which are connected articulatedly to the base part at their lower end and are pivotal about approximately 90° or more in relation to the base part, from a position perpendicular to the base part into a position substantially parallel to the base part.

A rack of this kind is known for example from EP Patent 0612301 corresponding to German Offenlegungsschrift No. 41 38 507. In the known racks, a rigid upper frame part and a rigid lower frame part are each provided so that there can be suspended from the upper rigid frame part, which is partly in the form of parallel rails, rods which can be displaced on these rails and have flexible material webs hanging therefrom. The side parts are defined by four corner posts which have in the centre an articulation point and are each connected articulatedly to the upper frame part and the lower frame part so that the posts can each be bent at their centre and in this way the entire rack can be folded up.

The known rack is, however, provided such that it may only be folded up in the empty condition—that is to say without the bags received in the rack. Moreover, the known rack is relatively complicated to manufacture, since each individual post has to have a total of three different hinge points, namely a hinge opposite the lower frame part, a hinge opposite the upper frame part, and in addition a bending point in the centre of the post.

Against the background of this prior art, the object of the present invention is to provide a folding rack which is simpler in construction and easier to manufacture.

BRIEF DESCRIPTION OF THE INVENTION

The objects of the invention are achieved in that there is articulated to the upper end region of the lateral frame parts a cross strut which is pivotal in relation to the lateral frame part in the direction of an opposing cross strut, into a position substantially parallel to the base part, with the free ends of the cross struts pivoted toward one another being connectable to one another in a substantially rigid manner so that the upper ends of the side parts, which are connected by the cross struts articulated thereto and rigidly connected to one another, are held at a minimum spacing defined by the cross struts.

More particularly, the invention comprises a folding rack for receiving and transporting bags, for receiving objects, to be suspended in the rack. The rack has a base part and side frame parts which are connected articulatedly to the base part at their lower end and are pivotal at least about 90° or more in relation to the base part, from a position perpendicular to the base part into a position substantially parallel to the base part. A cross strut is articulated to an upper end region of each of the side frame parts. The struts are pivotal toward one another parallel to the base part, and free ends thereof are connectable to one another in a substantially rigid manner so that the upper end regions of the side frame parts are held by the cross struts, which are articulated to the upper regions of the side frame parts and are rigidly connected to one another, at a minimum spacing defined by the cross struts. In a mutually connected condition, as above described, the free ends of the cross struts engage in one another in a connection region and are held together in substantially rigid manner by a pipe clamp reaching over the connection region, and in an unfolded condition the side parts extend parallel to one another and are substantially perpendicular to the base part, so that similar racks can be stacked on top of one another with side frame parts aligned with one another.

BRIEF DESCRIPTION OF THE SEVERAL VIEWS OF THE DRAWINGS

FIG. 6 shows a series of drawings showing how the rack according to the invention is set up, and FIG. 7 shows a series of drawings showing how the rack is folded up.

Figure 1:
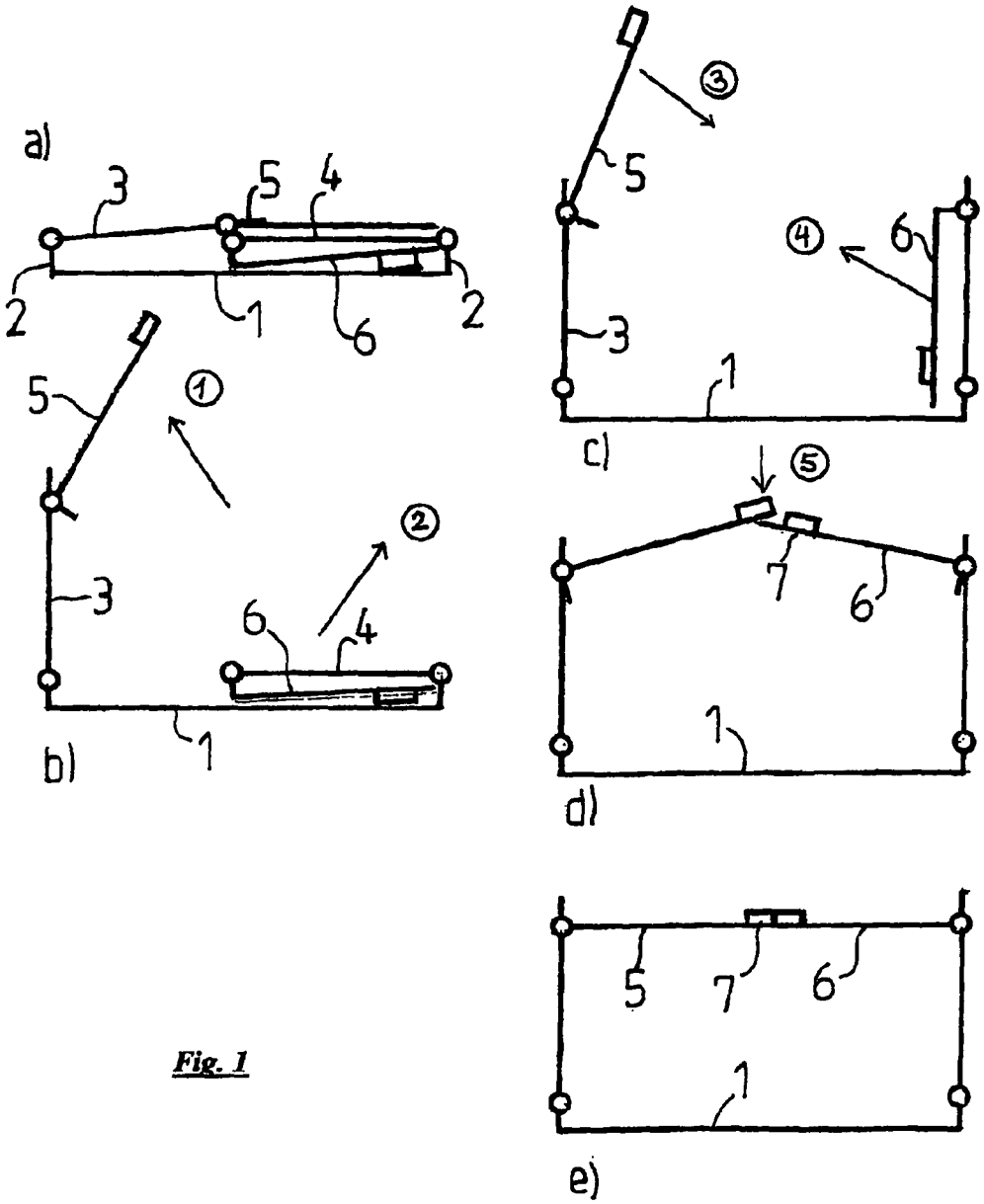
FIGS. 1*a-e* show sketches of the principle of a folding rack in various positions.

Visible in FIG. 1 and shown in side view is the base part 1, with short corner posts 2 joined laterally thereto, side parts 3, 4 and cross struts 5 and 6 articulated to the side parts 3 and 4 respectively.

DETAILED DESCRIPTION OF THE INVENTION

In the case of the subject of the present invention, moreover, the side parts preferably substantially comprise two parallel, mutually connected corner posts, although each of the corner posts now has only two articulation points, namely an articulation point for connecting it to the base part and an articulation point in the upper region for connecting it to the cross strut. Once the side parts have been set up, the cross struts of the opposing side parts are pivoted toward one another and connected to one another in an overlapping connection region.

In the preferred embodiment of the invention, it is provided in this case for the free ends of the cross struts to engage in one another and to be held together in substantially rigid manner by a pipe clamp reaching over the engagement region.

In this case, furthermore, in the preferred embodiment of the invention the pipe clamp is held resiliently on one of the cross struts and pretensioned in the direction of the region of connection between the two cross struts, so that when the two free ends of the cross struts are pivoted toward one another they first engage in one another, and the resiliently pretensioned pipe clamp is at the same time first deflected in opposition to the resilient pretension and then snaps back and reaches over the connection point, so that it holds the two ends of the cross struts together.

In this way, a rigid connection is achieved between the two cross struts in a relatively simple manner, and hence a rigid connection between the two side parts is also achieved provided the articulated connection between the cross struts and the side parts does not allow any relative displacement in relation to the cross struts in this unfolded position.

Particularly preferred is an embodiment of the invention in which there extend between the side parts flexible material webs which, when the side parts are set up, extend horizontally between opposing side parts and are tensioned by the upright side parts. These flexible material webs then, for their part, exert a tensile force on the side parts and draw the side parts toward one another, while the cross struts ensure a minimum spacing between the side parts and hence fix the position of the side parts unambiguously. Preferably, a plurality of material webs are tensioned in parallel between the side parts, and preferably the material webs running transversely are also connected to one another by generally vertical or indeed inclined connection webs so that receiving bags for objects are formed between the tensioned horizontal material webs and the connection webs extending between them.

The cross struts are in this case preferably dimensioned such that in the unfolded condition of the side parts the latter extend substantially parallel to one another and perpendicular to the base part, with the corner posts which define the side parts moreover being aligned with corresponding corner posts of the base part so that the unfolded racks can be stacked on top of one another.

In this case, the articulation regions of the cross struts are preferably arranged on the side parts or the posts thereof such that the upper ends of the posts remain free and the upper ends of the corner posts of the side parts and the lower ends of the corner posts of the base parts are preferably constructed such that they engage in one another when a plurality of racks are stacked on top of one another and hence are prevented from being displaced laterally.

In the preferred embodiment of the invention, the upper ends of the corner posts of the base part are similar in construction to the upper ends of the corner posts of the side parts and moreover the side parts or corner posts of the side parts are articulated to the corner posts of the base parts such that when the rack is in the folded-up condition, with the side parts folded underneath, the upper ends of the corner posts of the base parts are exposed. The corner posts of the base parts are in this case generally relatively short post parts which extend substantially perpendicular to the plane otherwise defined by the base part. This construction makes it possible to stack the folded-up racks on top of one another as well.

To fold them up, or in other words to fold in the side parts, it may moreover be advantageous if the cross struts articulated to the upper regions of the side parts or the corner posts of the side parts are pivotal into a position parallel to the side parts and next to the side parts or the corner posts of the side parts, and may be locked thereto. It is equally possible to fold up the rack by pivoting the cross struts into a position in which they extend more or less as a prolongation of the side parts or the corner posts of the side parts.

In this case, moreover, it is advantageous to articulate the cross struts to the corner posts of the side parts such that one of the parts has a pivot pin defining an axis and the other of the parts is received thereon by means of a slot, so that the cross strut or the corresponding other part may be displaced on the pin by way of the slot and hence certain positions of the cross struts may be locked relative to the side parts.

Other advantages, features and possible applications of the present invention will become apparent from the description which follows of preferred embodiments in the attached drawings.

It will be understood that in the diagrammatic side view illustrated in FIG. 1 only the front edges of the base part and the side parts are in each case visible, and these are preferably formed by cross struts and corner posts which generally comprise rectangular tubes. It can clearly be visualized that the same elements are duplicated in a plane behind the plane of the paper and that they are connected to the elements in the plane of the paper, parallel thereto, by struts or the like and so, taken as a whole, form the rack.

In FIG. 1, the rack is completely folded up. A particular feature to be noted here is that the cross strut 5 is unfolded in such a way that it is virtually a prolongation of the side part 3 and lies over the side parts 4, while the cross strut 6 is folded back parallel to the side part 4 and is preferably locked thereto.

In FIG. 1*b*, the left-hand side part 3 has been set up. In FIG. 1*c*, in addition, the right-hand side part has also been set up, while the cross struts have retained their original position in relation to the side parts 3 and 4, the position they had in the folded-up condition.

In FIG. 1*d*, the cross struts 5, 6 have been pivoted toward one another and engage with one another by their free ends. Here, a pipe clamp 7 is visible, mounted resiliently on the cross strut 6 and deflected somewhat as the two free ends of the cross struts 5, 6 are pushed inside one another, snapping back only in the position illustrated in FIG. 1*e* and hence reaching over the two mutually connected ends of the cross struts 5, 6. In this way, the cross struts 5, 6 are held rigidly together by the pipe clamp 7 reaching over them. It will be understood that all that has to be done to fold up the rack is to push the pipe clamp 7 to the right in opposition to the force of the resilient pretension so that the two ends of the cross struts 5, 6 can be moved apart again and the rack then folded up in the reverse order.

FIGS. 2*a-e* show precisely the same sequence of folding up a rack, in this case the rack differing from the rack in FIG. 1 only in that there are now parallel webs 8 of a flexible material extending between the two side parts 3, 4, and these webs 8 are, for their part, connected to one another by vertical connection webs 9 so that substantially rectangular bags are formed between the horizontal webs 8 and the vertical webs 9. In the folded-up condition, in accordance with FIGS. 2*a* and 2*b*, the bags are still loosely folded up, hanging between the two side parts 3, 4, or they lie on the base part 1. When the side parts 3, 4 are set up, the horizontal webs 8 are tensioned, reaching their full tension when the two cross struts 5, 6 are brought together and connected rigidly to one another, so that they keep the two side parts 3, 4 at a predetermined minimum spacing which is dimensioned such that in this condition the material webs 8 are tensioned just sufficiently to be taut. Moreover, the cross struts are also dimensioned such that in this condition the two side parts 3, 4 or the corner posts thereof extend substantially parallel and vertically with respect to the plane of the base part and precisely in a prolongation of the short corner posts 2 of the base part.

Figure 2:
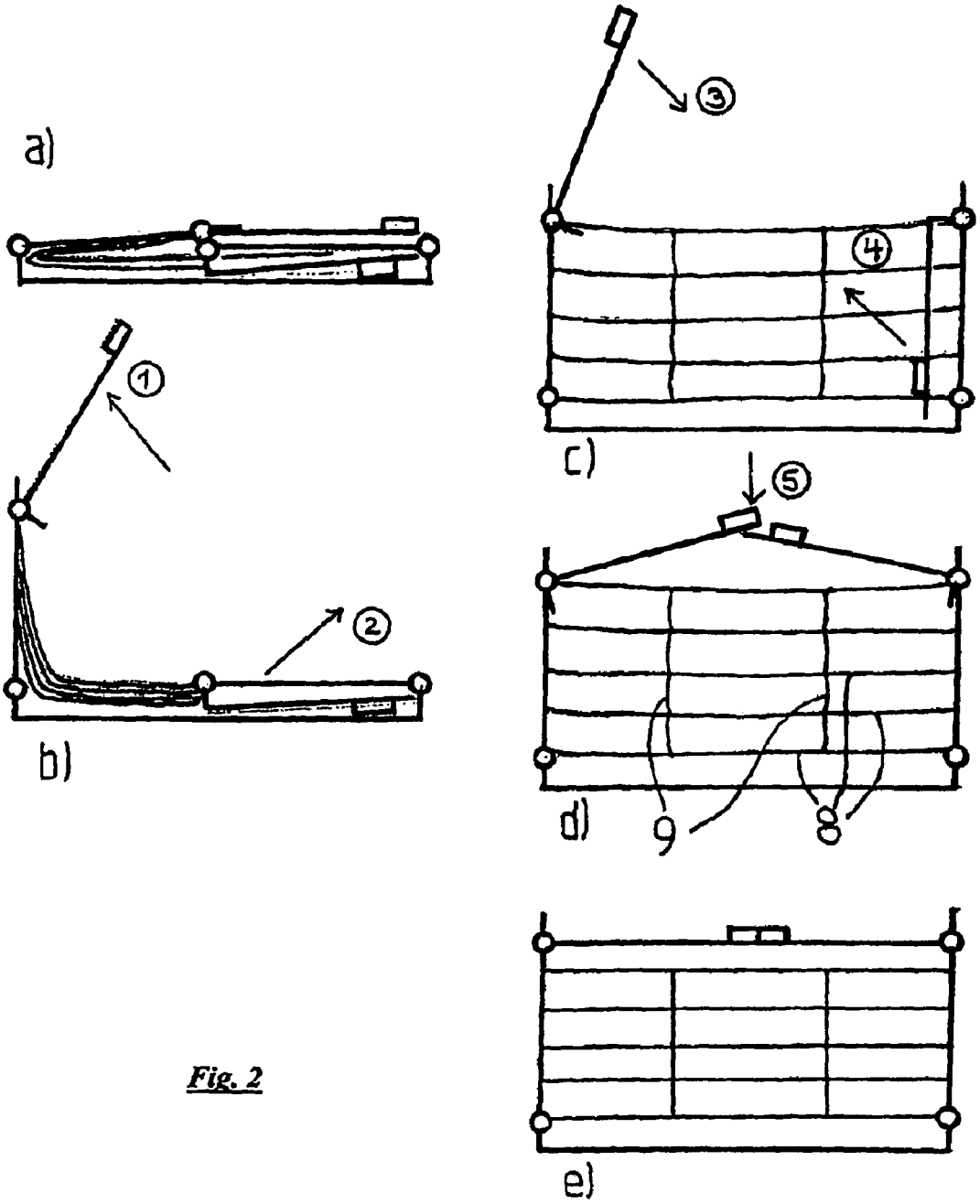
FIGS. 2*a-e* show a similar embodiment to that of FIG. 1, but with bags suspended in the rack, in similar positions of unfolding to those in FIGS. 1*a-e,*
Figure 3:
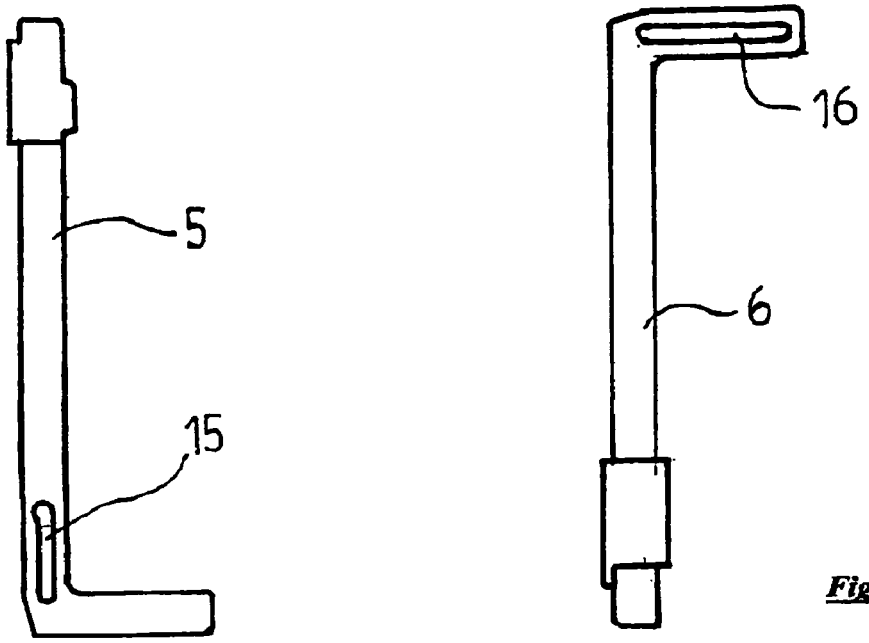
FIG. 3 shows the cross struts in isolation.

FIG. 3 shows the two cross struts 5 and 6 in isolation, with the cross strut 5 in FIGS. 1 and 2 being articulated to the side part 3 visible on the left, while the cross strut 6 is articulated to the opposing right-hand side part 4. It will be seen that the two cross struts 5, 6 each have a slot 15 and 16 respectively, although the slot 15 of the cross strut 5 extends in the longitudinal direction of the cross strut 5, whereas the slot 16 of the cross strut 6 extends in the transverse end limb of the cross strut 6. This differing arrangement of the slots is associated with the desired differences in the end positions which the cross struts 5, 6 can adopt relative to the side parts 3 and 4 in accordance with FIGS. 1 and 2. The corresponding mechanism will be indicated more clearly in FIG. 5.

Figure 4:
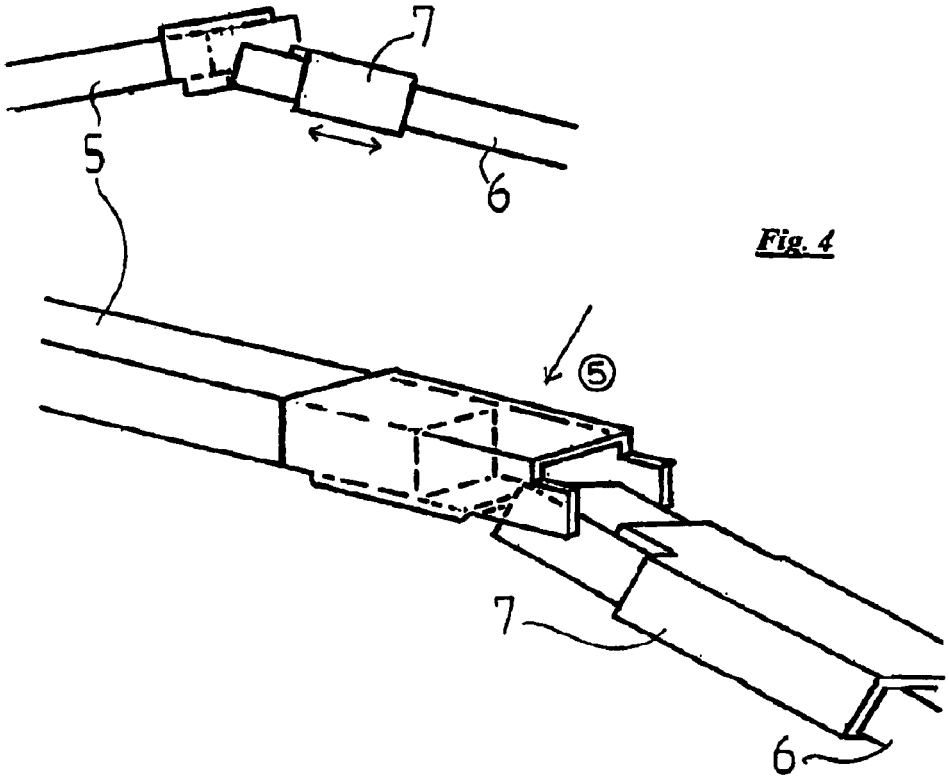
FIG. 4 shows a sketch to illustrate the way opposing cross struts are connected.

FIG. 4 shows the way the two cross struts 5, 6 are connected at their free ends. In the present example, the cross strut 5 is provided with a widened end portion in which the end portion of the cross strut 6 can engage fittingly. Moreover, the cross strut 6 is provided with a pipe clamp 7 which is held resiliently on the cross strut 6. When the two free ends of the cross struts 5, 6 are pushed together, the cross strut 6 engages in the open end of the cross strut 5, and the end of the cross strut 5 at the same time pushes the pipe clamp 7 back somewhat, in opposition to the resilient pretension thereof. As soon as the cross struts 5, 6 have reached the mutually flush position illustrated in FIGS. 1*e* and 2*e*, the pipe clamp 7 snaps back out of its resiliently pretensioned position and in so doing reaches over part of the end portion of the cross strut 5 as well, so that a rigid connection is made between these two parts.

Figure 5:
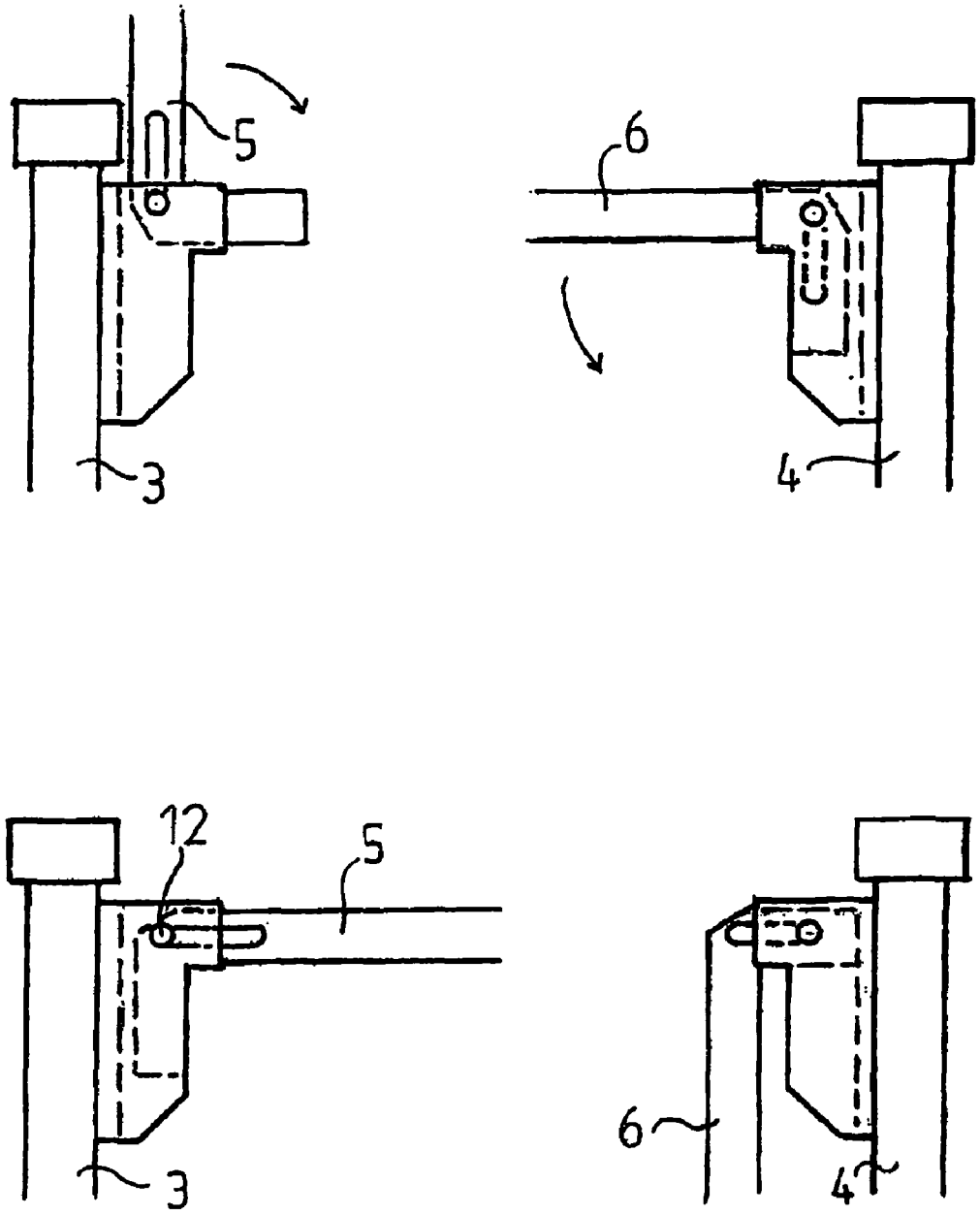
FIG. 5 shows details of the connection between the upper region of corner posts of side parts and the cross struts.

FIG. 5 shows, in the left-hand part of the figure, both the corner post of the side part 3 and the cross strut 5 mounted articulatedly thereon. The side part 3, or the corner post thereof, is provided with a holding part which is U-shaped in cross-section and between the limbs of which a pivot pin 12 extends. The pivot pin 12 at the same time extends through a slot in the cross strut 5 which runs in the longitudinal direction of the cross strut 5. In the position illustrated top left in FIG. 5, the cross strut 5 is pivotal in relation to the side part 3 about the pin 12. However, if, in the position illustrated top left in FIG. 5, the cross strut 5 is displaced downward so that the pin runs up the slot, then the cross strut 5 abuts against the side part 3 by means of a portion lying below the pivot pin, and cannot be pivoted—or at least only about a small angle. This relative position is illustrated in FIGS. 1*a-c* and FIGS. 2*a-c*. Once the cross strut 5 has been pulled up into the position illustrated top left in FIG. 5, however, the cross strut 5 can be pivoted into the position illustrated bottom left in FIG. 5. Because of the end limb additionally joined onto the cross strut 5, however, this end limb also finally abuts against the side part 3 and so defines the illustrated position, in which the cross strut 5 extends substantially perpendicular to the side part 3.

The cross strut 6, visible on the right in FIG. 5, may similarly be locked in its position aligned perpendicular to the side part 4 (top right in FIG. 5) as a result of the pivot pin, here too, being displaced in a slot into a position in which the end limb of the cross strut 6 abuts against the side part 4. In this case, the slot extends perpendicular to the longitudinal direction of the cross strut 6 in the end limb joined onto the end of the cross strut 6. In the position of the pin in the slot which is illustrated at the bottom of FIG. 5, the cross strut 6 is pivotal in relation to the side part 4.

FIG. 6 shows, in a series of individual drawings 1-12, how the folded-up rack can be set up and put into the end position illustrated for example in FIG. 2*e*. The procedure here corresponds substantially to that already described in connection with FIGS. 1 and 2.

FIG. 7 shows a series of individual drawings showing how the rack is folded up. Here, the only point to note is that, as can be seen for example from parts 1 and 2 of FIG. 7, the pipe clamp 7 has to be withdrawn and disengaged from the free end of the cross strut 5 so that the cross strut 5 can be pivoted upward and disengaged from the free end of the cross strut 6. All the other procedures correspond simply to a reversal of the procedures described in FIGS. 1*a-e* and 2*a-e*.

Also important is the fact that the side parts can if possible also be locked to the vertical corner posts 2 of the base part 1 so that the side parts 3, 4 can be held substantially upright once set up even if the cross struts are not yet connected and even if they cannot hence put the flexible webs 8 of the bags under sufficient pretension yet.

As can be seen from parts 6 and 8 of FIG. 7, the corner posts of the side parts 3 and 4 are pushed into the corresponding corner posts 2 of the base part and can be unlocked at the same time by way of a cross strut which connects two corner posts of each side part to one another. As is furthermore visible from FIG. 5, the upper ends of the corner posts of the side parts 3 and 4 are widened and substantially correspond in their cross-section to the cross-section of the corner posts 2 of the base part 1. By contrast, the lower ends of the corner posts 2 of the base part 1 or additional, joined-on parts on the base part 1 which are aligned with the corner posts 2 substantially correspond in their cross-section to the corner posts of the side parts 3 and 4, so that these lower ends of the corner posts 2 or the corresponding joined-on parts can be inserted fittingly into the widened portions of the corner posts of the side parts 3 and 4, as illustrated in FIG. 5. This makes it possible to stack the folding racks on top of one another both in the set-up condition, that is to say in the unfolded condition, and in the folded-up condition. Among other things, the fact that the cross struts 5, 6 are articulated below the upper free ends of the corner posts of the side parts 3 and 4 to the latter makes it possible to stack them on top of one another in the unfolded condition as well.

The invention claimed is:

1. A folding rack for receiving and transporting objects to be placed in webs suspended in the rack, said rack being free standing in an open position in the absence of exterior support or angle braces and having side frame parts, cross struts and a rigid, non-folding, generally horizontal base part defining a bottom plane, said base part comprising four non-folding base corner posts rigidly connected to and extending perpendicularly to said bottom plane and, each side part comprising two rigidly connected corner posts, said side parts connected articulatedly at a lower end region to the corner posts of the base part and being pivotable at least about 90° in relation to the base part, from a position substantially parallel to the bottom plane in a closed position to a position perpendicular to the bottom plane in an open position, said side parts being lockable to said corner posts of the base part in the open upright position; said cross struts being articulated to an upper end region of each of the side frame parts, said struts being pivotable toward one another parallel to the bottom plane in an open position, and in said open position, free ends thereof being connectable to one another in a substantially rigid manner so that in the open position the upper ends of the side parts are held by the cross struts, at a minimum spacing defined by the cross struts, wherein in a mutually connected condition the free ends of the cross struts engage with one another in a connection region and are held together in substantially rigid manner by a clamp reaching over the connection region, and in that in an folded condition the cross struts fold substantially parallel to one another and substantially parallel to the bottom plane so that similar racks can be stacked on top of one another with side parts parallel with one another, said folding rack requiring only connection of the cross struts for securing the rack in the open position, said folding rack being foldable from the open position to the closed position so that the entire folded rack is contained within an area defined by the corner posts of the rigid base part.

2. The folding rack of claim 1 wherein the rack is arranged for suspending of the webs from the side parts.

3. The folding rack of claim 2 wherein the webs are suspended from the side parts by horizontal webs connected to the side parts.

4. A folding rack according to claim 1 wherein points at which the cross struts are articulated to the side parts are constructed such that the cross struts, as well as defining a minimum spacing, at the same time define the maximum spacing between the side parts.

5. A folding rack according to claim 1 wherein tensioning means are provided on the side parts, and these allow flexible material webs extending between the open upright side parts to be tensioned.

6. The folding rack of claim 5 wherein the tensioning means permits tension to be increased upon the flexible webs.

7. A folding rack according to claim 1 wherein a height of the rack, defined by the side parts, is at least half a width of the rack, defined by spacing between the open upright side parts.

8. A folding rack according to one of claim 1 wherein when the racks are stacked on top of one another the upper free ends of the side parts are each defined by upper ends of corner posts, and in that the base parts also have corner posts, which are flush with the corner posts of the side parts when the side parts are unfolded, with the lower end of a corner post of the base part engaging in the upper end of a corner post of a side part when the racks are stacked on top of one another and so being prevented from being displaced laterally.

9. A folding rack according to claim 8 wherein at least one of the cross struts is pivotal parallel and next to one of the corner posts of one of the side parts, and may be locked thereto.

10. A folding rack according to claim 8 wherein corner posts defining the side parts are pushed into corner posts of the base part so that an internal cross-section substantially corresponds to an external cross-section of the corner posts of the side part, with the corner posts of the base part and the corner posts of the side part additionally being connected to one another by a pivot pin and slot connection, with the corner posts of the side parts and the base parts being locked in alignment with one another in a first position of the pivot pin in the slot and the corner posts of the side parts being pivotal in relation to the corner posts of the base part in a second position of the pivot pin in the slot.

11. A folding rack according to claim 1 wherein the webs suspended in the racks are at least two webs of a flexible material for objects which webs are horizontally tensioned between the side parts in an unfolded condition.

12. The folding rack according to claim 11 wherein connection webs extend between adjacent suspended webs.

13. A folding rack according to claim 12 wherein the upper ends of the corner posts of the base part are similar in construction to the upper ends of the corner posts of the side parts, and in that the side parts are articulated to the corner posts of the base parts such that when the side parts are folded in, the upper ends of the corner posts of the base parts are exposed so that folded-up racks can also be stacked on top of one another in such a way that they are prevented from slipping.

14. A folding rack according to claim 1, wherein the free ends of the cross struts are connectable to one another in a substantially rigid manner by a pipe clamp and the pipe clamp is held resiliently on one of the two cross struts and pretensioned into a position reaching over the region of connection of the cross struts.

* * * * *